United States Patent [19]

Brenner et al.

[11] 4,170,882

[45] Oct. 16, 1979

[54] AGITATOR HAVING VANES ADJUSTABLE TO PROVIDE DIFFERENT STROKE LENGTHS

[75] Inventors: Robert A. Brenner, St. Joseph; Victor W. Cuthbert, Sodus, both of Mich.

[73] Assignee: Whirlpool Corporation, Benton Harbor, Mich.

[21] Appl. No.: 861,822

[22] Filed: Dec. 19, 1977

[51] Int. Cl.[2] ..... D06F 13/06

[52] U.S. Cl. ..... 68/133; 68/134; 366/277; 366/278; 416/82

[58] Field of Search ..... 68/131–134; 366/241, 276, 277, 278; 416/82

[56] References Cited

U.S. PATENT DOCUMENTS

| | | | |
|---|---|---|---|
| 1,930,241 | 10/1933 | Labisky | 68/133 X |
| 2,092,954 | 9/1937 | Carter | 68/134 |
| 2,208,102 | 7/1940 | Nelson | 68/134 X |
| 2,273,566 | 2/1942 | Faber | 68/133 |
| 2,289,419 | 7/1942 | Garubo | 68/133 |
| 2,422,545 | 6/1947 | Hanson | 68/133 |
| 2,821,840 | 2/1958 | Hays | 68/133 X |
| 3,213,651 | 10/1965 | Worst | 68/133 |
| 3,987,652 | 10/1976 | Ruble | 68/134 |

*Primary Examiner*—Philip R. Coe

*Attorney, Agent, or Firm*—Hill, Van Santen, Steadman, Chiara & Simpson

[57] ABSTRACT

An agitator for a vertical axis washing machine and for effecting uniform, repetitive oscillations about the machine axis has upper, lower and middle portions with different degrees of lost motion so that the agitator can achieve multiple stroke lengths and so relative motion can be effected between the vanes and the skirt, for example, because of different stroke lengths.

14 Claims, 7 Drawing Figures

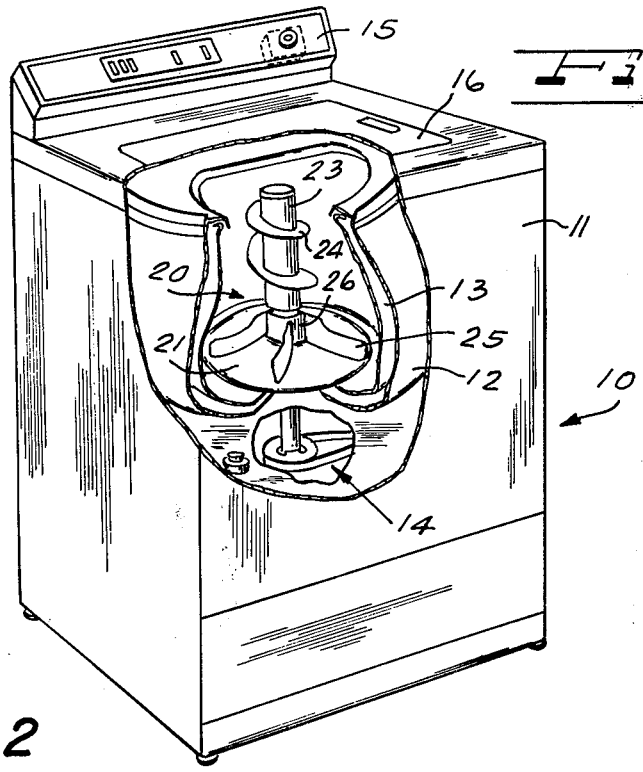
Fig. 1
Fig. 2
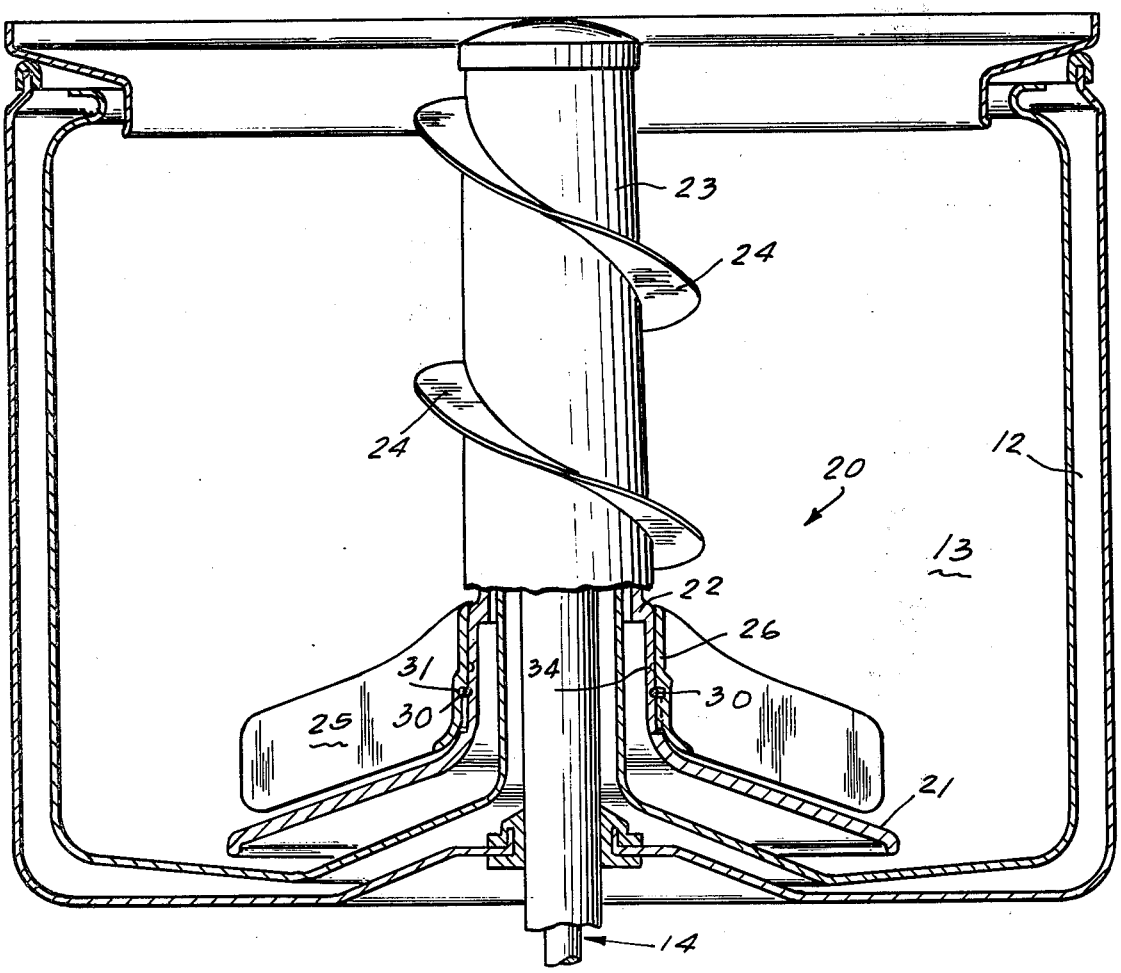

AGITATOR HAVING VANES ADJUSTABLE TO PROVIDE DIFFERENT STROKE LENGTHS

BACKGROUND OF THE INVENTION

1. Field of the Invention

The present invention relates to agitating elements for vertical axis clothes washing machine, and particularly to such agitator elements as have variable oscillation speeds or strokes.

2. The Prior Art

Ruble U.S. Pat. No. 3,987,652, assigned to the same assignee as the present invention, discloses an agitator including an oscillating body portion with rigid vanes and an auger portion which rotates unidirectionally in response to the oscillation of the body portion. A one-way clutch such as a ratchet clutch positively drives the auger in one direction, while the resistance of a tightly packed clothes load about the auger vanes may resist movement of the auger in the nondriving direction. When the clothes load is insufficient to prevent reverse oscillation, the auger will tend to oscillate with the lower scrubbing vanes and the skirt.

U.S. Pat. No. 3,213,651 discloses a washing machine having an agitator whose oscillatory stroke length may be selectively varied between 0° and 160° by means of lost motion devices carried in the top of the barrel. A first embodiment uses a nut riding on threads on the oscillating drive shaft and engaging an inner surface of the agitator. The position of an agitator cap controls the vertical space available to the nut for non-driving movement. In a second embodiment, shown in FIGS. 4–7, selected discrete stroke lengths can be obtained by rotating the agitator cap to vary the axial position of a member 73. Such axial position determines which of three variable-width slots 78, 79, 80 is engaged, for corotation of the drive shaft and agitator.

U.S. Pat. No. 2,273,566 shows a washing machine agitator having a stroke variable between zero and full travel, the stroke being varied by adjustment of a cap on the agitator to change frictional forces between the agitator barrel and the drive shaft.

Further, U.S. Pat. Nos. 2,821,840 and 2,422,545 disclose hydraulic drives and controls for varying agitator stroke length and stroke speed.

SUMMARY OF THE INVENTION

In a vertical axis clothes washing machine, a lost motion device incorporating driving and driven lugs or slots is mounted to act between a lower portion of the agitator barrel and skirt and a hub carried co-axially thereon. The hub in turn carries radially-extending agitator vanes. Vertical repositioning of the hub and vanes with respect to the skirt and barrel changes the stroke length of the vanes and, except in a full stroke, locked position, allows movement of the skirt with respect to the vanes. Thus the degree of vigor of the agitation provided to the clothes and fabrics in the washer may be varied with no need for complex motor speed change equipment. The agitator skirt always rotates through its fully oscillatory arc, while the vanes swing through the same or a lesser arc.

THE DRAWINGS

FIG. 1 is a perspective view, partly broken away, showing the improved agitator of the present invention in one embodiment.

FIG. 2 is a side sectional view of the washing machine tub, basket, and agitator lower portion.

THE PREFERRED EMBODIMENTS

Figure 3:
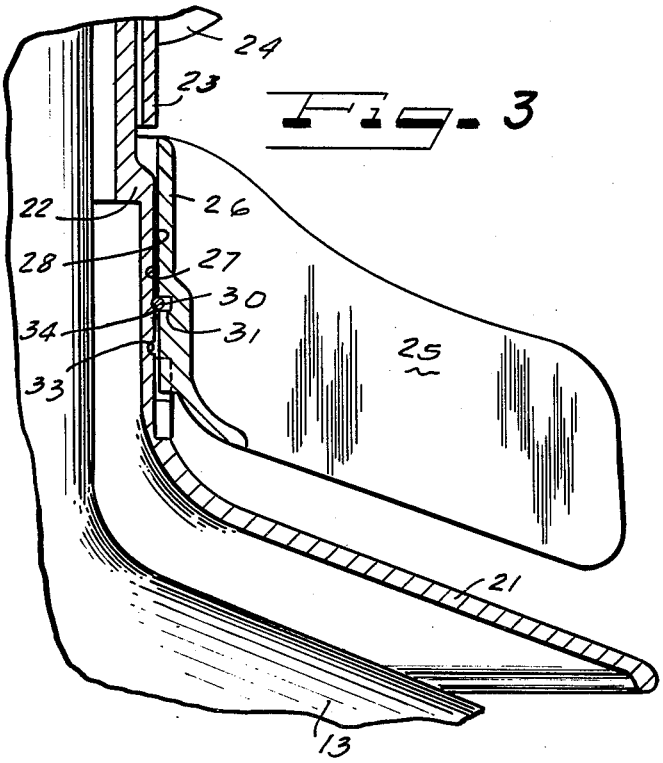
FIG. 3 is a detail, side sectional view of the lost motion device of the present invention.

A washing machine of the vertical axis type is shown at 10 in FIG. 1 having a cabinet 11 containing a tub 12 for holding wash liquid and a basket 13 therein for containing clothes and fabrics to be washed. A drive mechanism 14 is mounted in the lower part of the cabinet 11 and is controlled by appropriate elements on a control panel 15. A lid 16 in an upper part of the cabinet 11 gives access to the interior of the basket 13. An agitator 20 is mounted co-axially within the tub 12 and basket 13 and is selectively driven by the drive elements 14.

As also shown in FIG. 1, and in greater detail in FIG. 2, the agitator 20 comprises a skirt 21 which is generally conical in form and located in the lower part of the basket 13. An upstanding barrel 22 is joined to and carries the skirt 21 through a connection (not shown) to the drive elements 14. A suitable drive connection is shown in the Ruble U.S. Pat. No. 3,987,652. In the first embodiment, an auger agitator element 23 having a helical vane 24 thereon is carried about the upper part of the barrel 22. In accordance with the invention, lower, radially-extending scrubbing vanes 25 are carried on a hub 26 above the skirt 21. The hub 26 is mounted co-axially with and about the barrel 22 on cylindrical bearing surfaces 27, 28, respectively as shown in FIG. 3, and is selectively driven by the barrel 22 in accordance with the invention.

As shown in further, enlarged detail in FIG. 3, the hub 26 and vanes 25 carried thereon are vertically repositionable with respect to the barrel 22 and skirt 21, by means of a wire snap ring 30 carried retractably in a groove 31 formed on the inside bearing surface 27 of the hub 26. The wire snap ring 30 is selectively engageable in either of a pair of circumferential grooves 33, 34 spaced vertically or axially apart from one another in the exterior bearing surface 28 of the barrel 22. The snap ring wire 30 and the circumferential grooves 31, 33 and 34 permit relative rotation between the hub 26 and vanes 25 carried thereon and the barrel 22 and skirt 21, although fixing the relative axial positions between the parts. Movement of the hub 26 and vanes 25 from the upper position shown in FIG. 3, with the snap ring 30 engaged in the upper groove 34, to the lower position shown in FIG. 2, with the wire 30 engaged in the groove 33, is effected merely by grasping the hub 22 or one or more of the vanes 25 and pushing or pulling same axially.

Figure 4:
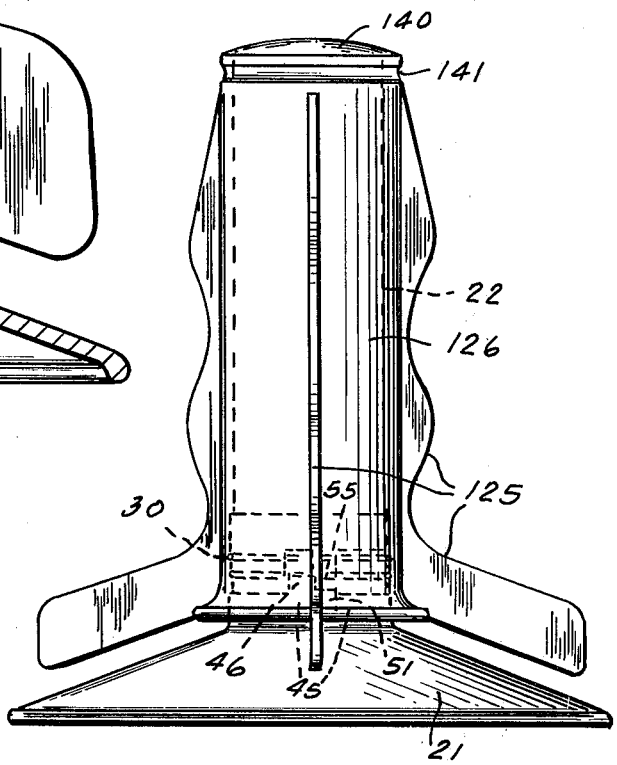
FIG. 4 is a side elevational view of a second agitator in accordance with the invention, with drive apparatus according to the invention shown in phantom.

FIG. 4 shows a second embodiment of the hub and vanes to which the present invention is adapted. The hub 126 is elongated, to extend the entire length of the barrel 22 and to cover the top thereof at a cap 140. The radial vanes 125 similarly extend in any desired configuration the length of the hub 126. A manual gripping ring 141 is provided at the top of the hub 126 for convenient raising and lowering of the hub 126 with respect to the barrel 22 and skirt 21.

Figure 5:
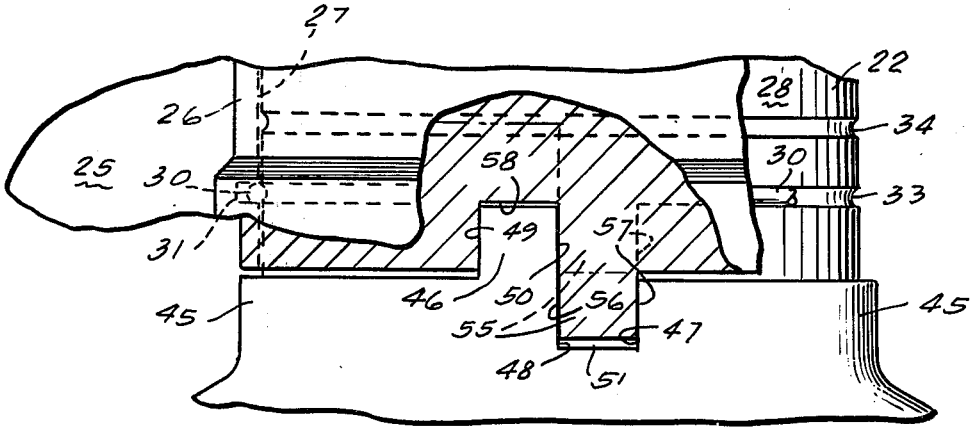
FIG. 5 is a detail side elevational view, partly broken away, showing the lost motion device of the invention.

Also depicted in FIG. 4, and shown in detail in FIG. 5, are lost motion means for selectively effecting desired drive motions in the hub and vanes 26, 25 or 126, 125. In accordance with the invention, a lower part of the barrel 22 is formed with two vertically spaced pairs of driving lugs 45, 46, each extending radially outwardly from the barrel bearing surface 28 and also having axial and circumferential dimensions, as shown in FIG. 5. Each lug 45, 46 of each pair has identical dimensions to the other of that pair. The axially lower drive lugs 45 have forward and rearward drive faces 47, 48, and the upper drive lugs 46 have forward and rear drive faces 49, 50. In the embodiment shown, the counterclockwise drive faces 50, 48, of the upper and lower drive lugs 46, 45, align axially with one another, although they need not. The space between the drive surfaces 47, 48, between the lugs 45, 45 of the lower pair, forms a slot 51.

The hub 26 has formed on an inside surface thereof an opposing pair of driven lugs 55 having forward and rearward faces 56,57 facing in opposite circumferential directions. The circumferential width of the driven lugs 55 is less than or equal to the width of the slot 51 formed between the faces 47, 48 of the lower drive lugs 45. A cut out or recess section 58 is provided vertically and circumferentially adjacent the driven lug 55 in the hub 26, for clearing the drive lug 46 of the barrel 22. Thus, when the hub 26 is in its downward position, as shown in FIG. 5, the driven lug 55 is engaged closely between the lower drive lugs 45, 45, in the slot 51 left therebetween. When the hub 26 is raised, so that the snap ring 30 is engaged in the upper groove 34, the driven lugs 55 rise out of the slots 51 and out of engagement with the drive surfaces 47, 48. In such raised position, lost motion results during operation because the driven surfaces 56, 57 of the lugs 55 are engageable only with the drive surfaces 49, 50 of the upper pair of drive lugs 46. Because the circumferential width of the upper drive lug 46 is restricted, the driven lug 55 and hence the hub 26 and scrubbing vanes 25 thereon are driven through only a limited, small oscillatory stroke.

Figure 6:
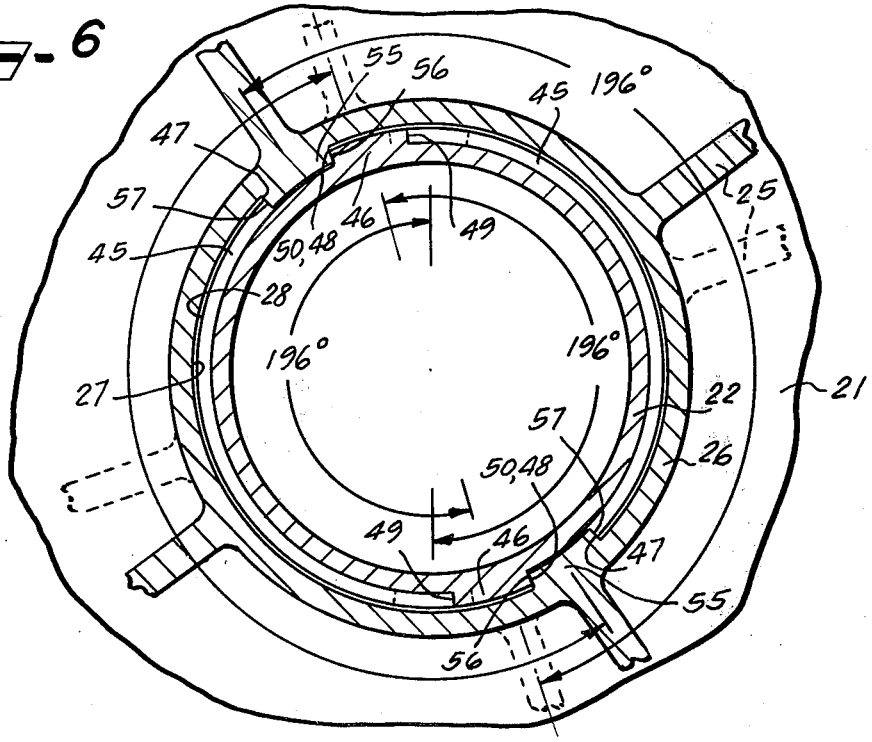
FIG. 6 is a cross-sectional view taken on the axis of the agitator through the lost motion device, showing movement of parts for full stroke oscillation.
Figure 7:
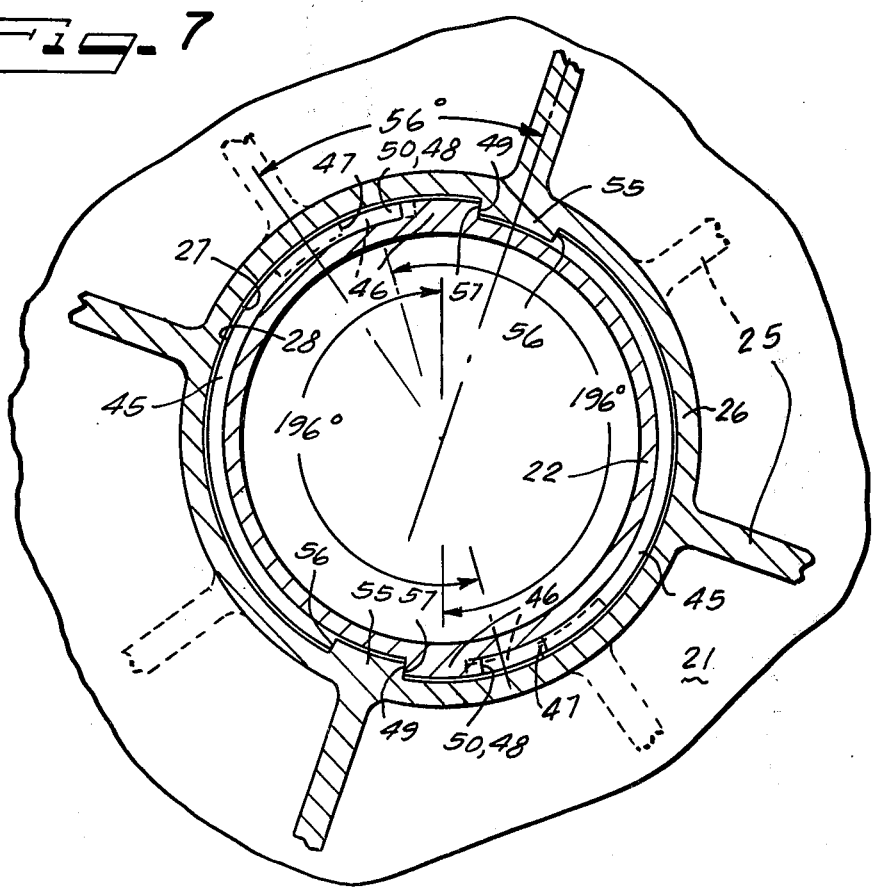
FIG. 7 is a cross-sectional view similar to FIG. 6, but showing a reduced oscillation stroke of the scrubbing vanes.

The operation of the hub 26 and vanes 25 thereon with respect to the barrel 22 and skirt 21 is shown in FIGS. 6 and 7, with the hub respectively lowered and raised with respect to the barrel 22. In the lowered position, of FIG. 6, the driven lugs 55, 55 of the hub 26 are engaged in the slots 51 formed circumferentially between the lower drive lugs 45, 45 on the exterior of the barrel 22. In the embodiment shown, when the barrel 22 and skirt 21 oscillate through an arc of 196°, driven by the drive means 14, the vanes 25 carried by the hub 26 will also be oscillated through 196°, since no relative motion is permitted between the driving and driven parts.

In FIG. 7, the hub 26 and vanes 25 have been raised vertically with respect to the skirt 21 and barrel 22. In such raised position, the driven lugs 55, 55 are raised clear of the first drive lugs 45, 45, and are engageable only by the surfaces 49, 50 of the second driving lugs 46, 46. In this position, the barrel 22 and skirt 21 continue to oscillate through their full 196° oscillatory arcs, as in FIG. 6, while the hub 26 and vanes 25 thereon are oscillated only through 56° strokes, as shown, where the arc width of each of the lugs 46, 55 is 20°. The amount of lost motion which decreases the arc of oscillation of the hub 26 from 196° to a smaller arc depends on the arc widths of the upper drive lugs 46 and of the driven lugs 55, with wider lugs providing a greater oscillatory arc to the hub 26 and vanes 25 than narrower ones. In the embodiment shown, where the upper drive lugs 46 are the same width as the slot 51 left between the driving lugs 45, the vanes 25 will be oscillated through an arc equal to the sum of the excess over 180° of the oscillatory arc of the barrel 22, plus the arc width of the drive lug and of the driven lug. Where either of the lugs 46 or 55 is made wider, the oscillatory arc of the barrel 22 is increased, the arc of the hub 26 will increase beyond 56°, as by the formula, stroke length of the barrel minus 180°, plus the arc width of the drive lug 46, plus the arc width of the driven lug 55.

Further embodiments may readily be devised, including providing further, axially spaced pairs of drive lugs as 45, 46, and further snap ring reception grooves 33, 34. Although these and various other minor modifications may be suggested by those versed in the art, it should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a washing machine of the vertical axis type, an agitator comprising:

an upstanding barrel and a generally conical skirt carried co-axially with and below said barrel, both being oscillatable through an arc about said vertical axis;

a hub carried above said skirt and journaled on the barrel about said axis;

a plurality of radially-extending vanes carried on said hub; and hub drive and stroke adjustment means carried on one of said barrel and said skirt for engaging said hub for selective full co-oscillation of the hub and vanes with the barrel and skirt and for selective partial co-oscillation of the hub and vanes with the barrel and skirt in response to a vertical position of the hub and vanes with respect to the barrel and skirt.

2. In a washing machine of the vertical axis type as defined in claim 1, the agitator thereof wherein the hub drive and stroke adjustment means comprises:

a pair of drive lugs affixed to the barrel and surfaces forming a pair of drive slots in the barrel axially spaced from the drive lugs, all adjacent said hub; and a pair of driven lugs carried on said hub in selectively engageable relation to said drive lugs in one vertical position of the hub with respect to the skirt and continuously engaged in said drive slots in a second vertical position of the hub with respect to the skirt.

3. In a washing machine of the vertical axis type as defined in claim 2, the agitator thereof, further comprising:

a snap ring and groove means for maintaining the hub in its selected vertical position, the means comprising a snap ring carried in one of the barrel and hub and a pair of vertically-spaced grooves alternately engageable with said snap ring and formed in the other of said barrel and hub.

4. In a washing machine of the vertical axis type as defined in claim 1, the agitator thereof wherein:

the drive lugs and drive slots have center lines each spaced 180° apart about a circumference of the barrel on an outside surface thereof and the drive slots have an arc width in the circumferential direction; and wherein the drive lugs of the hub have center lines spaced 180° apart and have an arc width in the circumferential direction not exceeding that of the drive slots, whereby when the skirt and barrel oscillate through a first arc length and the hub is in its said one vertical position, the hub and vanes are oscillated through a second arc length of the sum of the arc widths of each drive lug and each driven lug plus the first are length minus 180°.

5. In a washing machine of the vertical axis type as defined in claim 1, the agitator thereof, wherein the hub and vanes thereon extend the full axial length of the barrel.

6. In a washing maching of the vertical axis type as defined in claim 1, the agitator thereof wherein the hub extends only a part of the axial length of the barrel, and the agitator further comprises a unidirectionally-rotatable auger element carried on said barrel upwardly of the hub.

7. A vertical-axis washing machine agitator having an adjustable stroke length independent of motor speed, the agitator comprising:

a one-piece upstanding barrel and skirt depending downwardly and outwardly from a lower part of said barrel, the barrel and skirt being rotatably oscillatable through an arc about said axis;

a hollow hub carried on and about said barrel above said skirt;

a plurality of radially-extending scrubbing vanes carried on said hub and above said skirt;

said barrel carrying on an exterior surface thereof at least one pair of drive lugs and one pair of surfaces forming drive slots, the lugs and slots of each pair having centers spaced 180° apart, the lugs and slots having circumferential abutment surfaces spaced circumferentially apart from each other, and each of the pairs of lugs and slots having a circumferential width;

vertical position selection and retention means for fixing a position of the hub vertically with respect to the barrel and skirt; and said hub carrying on a radially interior surface thereof a pair of driven lugs each selectively fixably engageable in a first vertical position in one of said drive slots and alternately engageable in a second vertical position against said drive lugs upon alternate oscillations of the skirt and barrel, whereby the stroke length of the vanes with respect to the skirt may be varied by moving the hub vertically.

8. An agitator as defined in claim 7, wherein the vertical position selection and retention means comprise a snap ring carried in one of the hub and the barrel and at least two vertically-spaced grooves formed in the other of the hub and the barrel, the ring selectively engaging one of the grooves to fix the position of the hub with respect to the barrel.

9. An agitator as defined in claim 7, wherein the hub and vanes thereon extend the full axial length of the barrel.

10. An agitator as defined in claim 7, wherein the hub extends only a part of the axial length of the barrel and a unidirectionally-rotatable auger element is carried on said barrel upwardly of the hub.

11. In an agitator for a vertical-axis washing machine, the agitator comprising a one-piece upstanding barrel and an integral skirt downwardly and outwardly depending co-axially therefrom, the barrel and skirt being oscillated about the vertical axis through repetitive arcs of alternating direction, and a plurality of vanes extending radially of the barrel and upwardly of the skirt, the improvement comprising:

a hub mounted on and about the barrel for rotation with respect thereto about said axis and carrying the vanes;

a first pair of drive lugs extending radially outwardly from said barrel adjacent said hub, said first pair of drive lugs having an axial height and a circumferential width about the barrel and terminating in axially- and radially-extending abutment surfaces spaced equidistantly on either side of a diameter of the barrel bisecting each of the first pair of drive lugs;

a second pair of drive lugs also extending radially outwardly from said barrel adjacent said hub, said second pair of drive lugs having an axial height and a circumferential width about the barrel and terminating in axially- and radially-extending abutment surfaces spaced equidistantly on either side of a diameter of the barrel bisecting each of said second pair of drive lugs, the second pair of drive lugs being axially positioned suprajacent said first pair of drive lugs, and the circumferential width of each of the second pair of drive lugs being less than that of the first pair of drive lugs;

a pair of driven lugs extending radially inwardly from the hub, axially thereof, and circumferentially thereabout to engage selectively against the abutment surfaces on one of the first and second pairs of drive lugs upon driving oscillations of the barrel, each of the driven lugs having a circumferential width not greater than that left between the abutment surfaces of the first pair of drive lugs; and axial position retention means arranged between the hub and the barrel for retaining the hub in a selected one of fixed first and second axial positions with the driven lugs thereon selectively engaging respectively one of the first and second pairs of drive lugs via abutment surfaces thereon upon each oscillation of the barrel, whereby adjustment of the vertical position of the hub and vanes adjust the stroke arc through which the hub and vanes are driven, the drive and driven lugs co-rotating upon engagement thereof and rotating with respect to each other to lose motion when not so engaged during a portion of each oscillation stroke.

12. In an agitator for a vertical-axis washing machine as defined in claim 11, the improvement thereof wherein the driven lugs substantially fill the spaces left between the first pair of drive lugs, whereby the hub and barrel rotate substantially together in the first axial position of the hub.

13. In an agitator for a vertical-axis washing machine as defined in claim 11, the improvement thereof, wherein the axial position retention means comprise a snap ring carried in one of the hub and barrel and surfaces forming a plurality of cooperating grooves in the other one of the hub and barrel, each groove being engageable with the snap ring in a selected one of the axial positions of the hub.

14. For use in a vertical axis washing machine, an agitator having relatively movable upper, middle and lower portions including a common driving means, and lost motion means interconnecting said middle portion and said drive means to selectively vary the relative strokes of such middle portion with respect to the other upper and lower portions.

* * * * *